United States Patent [19]

Stritzke

[11] Patent Number: 4,730,583

[45] Date of Patent: Mar. 15, 1988

[54] VALVE STEM OIL DEFLECTOR

[75] Inventor: Bernard G. Stritzke, Hanover Park, Ill.

[73] Assignee: Microdot Inc., Darien, Conn.

[21] Appl. No.: 83,363

[22] Filed: Aug. 10, 1987

[51] Int. Cl.[4] ..... F01L 3/08; F16J 15/32

[52] U.S. Cl. ..... 123/188 P; 277/181; 277/184; 277/188 R; 277/189

[58] Field of Search ..... 123/188 P, 188 VA, 188 GC; 277/181, 184, 187, 188 R, 189

[56] References Cited

U.S. PATENT DOCUMENTS

| | | | |
|---|---|---|---|
| 2,157,995 | 5/1939 | Boyd | 277/184 |
| 2,906,255 | 9/1959 | Bunce | 123/188 P |
| 3,480,286 | 11/1969 | Kotsatka | 123/188 P |
| 4,124,220 | 11/1978 | Leone et al. | 123/188 P |
| 4,198,062 | 4/1980 | Grzesiak | 123/188 P |
| 4,317,436 | 3/1982 | Bornhart et al. | 123/188 P |
| 4,502,696 | 3/1985 | Kammeraad | 123/188 P |

*Primary Examiner*—Ira S. Lazarus

*Attorney, Agent, or Firm*—Lyman R. Lyon

[57] ABSTRACT

A molded thermoplastic valve stem oil deflector for an internal combustion engine comprises a two piece cup-shaped member having a skirt and a neck defined by two axially spaced radial flanges. The flanges have apertures therethrough defining a radially inwardly opening annulus for the acceptance of a conventional O-ring that seals on the valve stem and supports the oil deflector relative thereto.

1 Claim, 2 Drawing Figures

VALVE STEM OIL DEFLECTOR

BACKGROUND OF THE INVENTION

Valve stem oil deflectors for internal combustion engines are subjected to high material stress and environmental conditions that historically have been the source of premature fracture and failure. Accordingly, the auto industry is still searching for the optimum combination of materials and structural configuration for such deflectors.

SUMMARY OF THE INVENTION

The invention relates to a high strength, fracture resistant, inexpensively manufactured, easily assembled, molded thermoplastic valve stem oil deflector for an internal combustion engine. The oil deflector comprises a two piece cup-shaped member comprising a skirt and a neck defined by two axially spaced radial flanges. The flanges have aperatures therethrough defining a radially inwardly opening annulus for the acceptance of a conventional O-ring of relatively resilient material, that seals on the valve stem and positions and supports the oil deflector relative thereto.

DETAILED DESCRIPTION OF THE PREFERRED EMBODIMENT OF THE INVENTION

Figure 1:
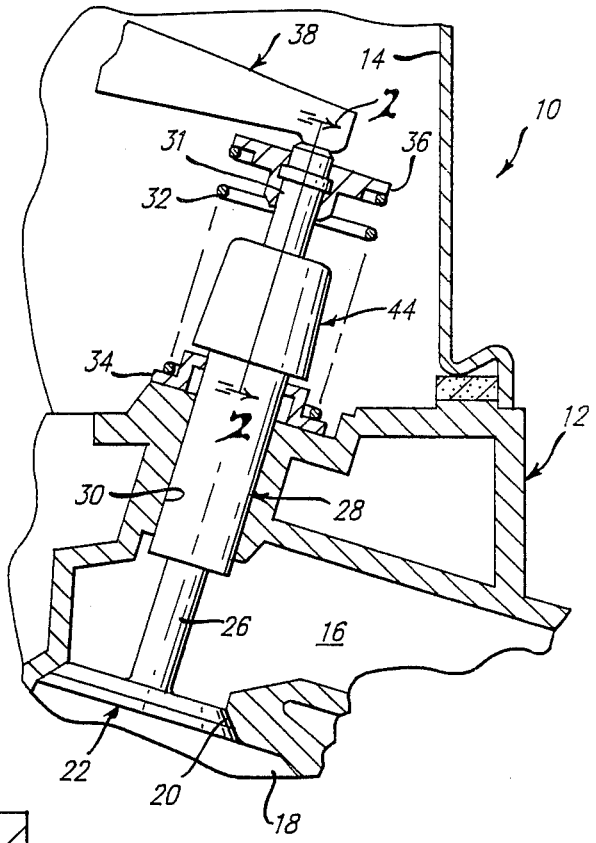
FIG. 1 is a fragmentary cross-sectional view of a portion of a conventional internal combustion engine provided with an oil deflector in accordance with a preferred embodiment of the present invention.

Referring to FIG. 1 of the drawing, a conventional internal combustion engine 10 comprises a cylinder head 12 having a rocker arm cover 14 mounted thereon. The cylinder head 12 is provided with a manifold 16 and a combustion chamber 18. The manifold 16 is provided with an annular valve seat 20 for seating of a conventional valve 22. The valve 22 has a stem portion 26 that reciprocates in a valve guide 28 which is supported within a bore 30 in the cylinder head 12.

An upper end 31 of the valve stem 26 is surrounded by a helical compression spring 32 which is supported at the lower end thereof by an annular bushing or spring locator 34 coaxially disposed about the valve guide 28 and bearing against the cylinder head 12. The upper end of the spring 32 abuts against a spring retainer 36. A rocker arm 38 bears against the upper end 31 of the valve stem 26 and is adapted to effect reciprocal movement of the valve 22 in a manner well known in the art.

In accordance with the present invention, the valve 22 is provided with a cup-shaped oil deflector generally designated by the numeral 44. The deflector 44 comprises an outer cup-shaped shell 46 made of a molded plastic material which is relatively stiff, dimensionally stable, and resistant to heat up to at least approximately 350° F. The preferable material is glass filled Nylon which has been found to have the requisite heat resistant characteristics. However, it will be apparent that equivalent materials can be used in fabricating the deflector 44 of the present invention noting that the material should be one that does not exhibit dimensional change due to heating and cooling.

The outer shell 46 of the oil deflector 44 has a radially extending neck portion 48 and a skirt portion 50 which flares outwardly toward the bottom end thereof. The neck portion 48 is provided with a central aperture 52 and for the acceptance of the valve stem 26 and an axially extending rib 54. The rib 54 mechanically traps a complementary oppositely and axially extending rib 56 on an annular retainer ring 58. The retainer ring 58 has an aperture 60 therein for the acceptance of the valve stem 26 and, in conjunction with the neck portion 48 of the outer shell 46, traps an O-ring 62 which effects both retention and sealing of the deflector 44 on the valve stem 26.

Figure 2:
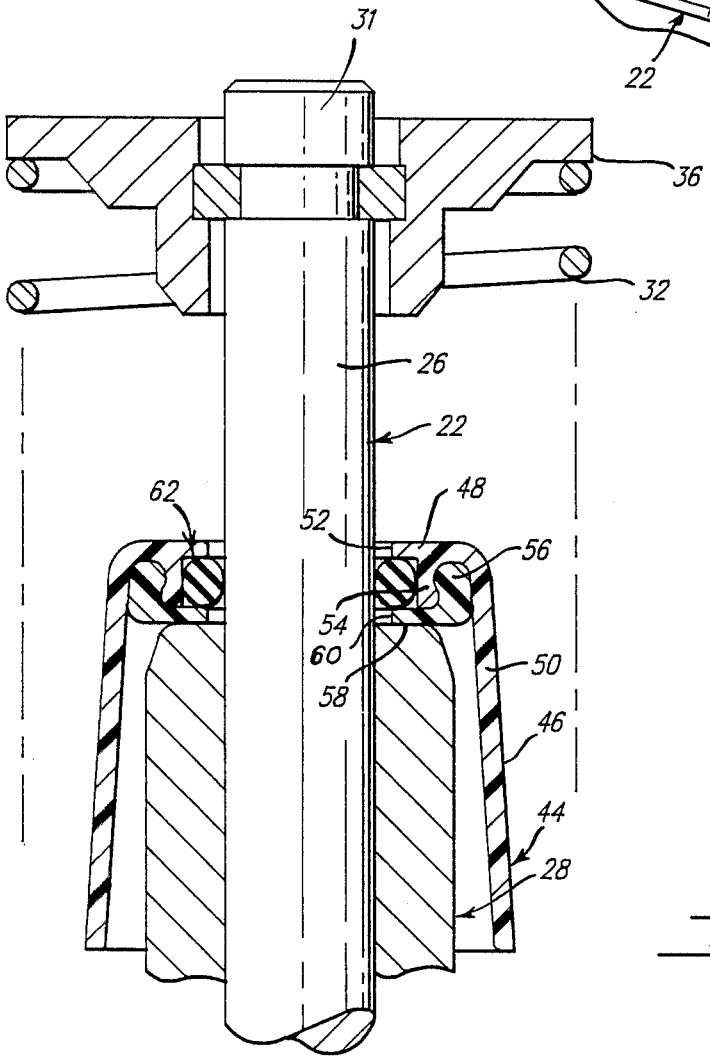
FIG. 2 is an enlarged cross-sectional view taken substantially along the line 2—2 of FIG. 1.

The oil deflector 44 is assembled upon the valve stem 26 of the valve 22 prior to assembly of the compression spring 32 and its associated parts. The deflector 44 is initially disposed adjacent to the guide 28 as shown in FIG. 2. The first time the valve 22 is moved to the open position (downwardly), the defector 44 engages the upper end of the valve guide 28 thereby forcing the deflector 44 axially along the valve stem 26 to a position that is permanently assumed on the valve stem 26.

It is to be noted that the oil deflector 44 is retained on the valve 22 by a resilient element which in turn is mechanically held by a relatively rigid shell. Thus, contraction, expansion, vibration, etc., of the valve, 22 or oil deflector 44 is isolated from its associated component by the O-ring 62. Moreover, the retention capability of the O-ring is not affected by relative movement between the valve 22 and deflector 44.

While the preferred embodiment of the invention has been disclosed, it should be appreciated that the invention is susceptible of modification without departing from the scope of the following claims.

I claim:

1. An oil deflector for attachment to the stem of a valve of an internal combustion engine or the like comprising a molded relatively rigid plastic cup-shaped shell having a generally cylindrical wall section and a transverse end wall, the end wall of said shell including an opening for receiving a valve stem, and an annular axially extending flange radially spaced from the cylindrical wall section of said shell and the stem of said valve;

an annular retainer ring having an axially extending flange acceptable between the axially extending flange on said shell and the cylindrical outer wall thereof, and having a radially inwardly extending portion coextensive with the transverse end wall on said shell, and;

an O-ring disposed between the transverse end wall of said shell and the radially inwardly extending portion of said retainer and resiliently engagable with the valve stem of said valve.

* * * * *